US009318285B2

(12) United States Patent
Sato et al.

(10) Patent No.: US 9,318,285 B2
(45) Date of Patent: Apr. 19, 2016

(54) SWITCHGEAR AND OPENING AND CLOSING METHOD THEREOF

(71) Applicant: HITACHI, LTD., Tokyo (JP)

(72) Inventors: Takashi Sato, Tokyo (JP); Kenji Tsuchiya, Tokyo (JP); Ayumu Morita, Tokyo (JP)

(73) Assignee: HITACHI, LTD., Tokyo (JP)

( * ) Notice: Subject to any disclaimer, the term of this patent is extended or adjusted under 35 U.S.C. 154(b) by 29 days.

(21) Appl. No.: 14/295,849

(22) Filed: Jun. 4, 2014

(65) Prior Publication Data

US 2014/0360853 A1 Dec. 11, 2014

(30) Foreign Application Priority Data

Jun. 7, 2013 (JP) ..... 2013-120346

(51) Int. Cl.
*H01H 3/40* (2006.01)
*H01H 33/666* (2006.01)
*H01H 33/42* (2006.01)

(52) U.S. Cl.
CPC ..... *H01H 33/666* (2013.01); *H01H 3/40* (2013.01); *H01H 33/42* (2013.01)

(58) Field of Classification Search
CPC ..... H01H 3/42; H01H 3/44; H01H 33/666
USPC ..... 200/501; 218/2, 4, 6
See application file for complete search history.

(56) References Cited

U.S. PATENT DOCUMENTS 3,597,556 A * 8/1971 Sharp ..... H01H 3/30 200/337
5,796,060 A * 8/1998 Fuchsle ..... H02B 13/035 218/79
8,191,444 B2 * 6/2012 Von Allmen ..... F16H 27/06 200/11 TC
2005/0139579 A1 * 6/2005 Sakamoto ..... H01H 3/46 218/118

FOREIGN PATENT DOCUMENTS

JP 2007-188734 A 7/2007
JP 2014-022342 A 3/2014

* cited by examiner

*Primary Examiner* — Vanessa Girardi
(74) *Attorney, Agent, or Firm* — Mattingly & Malur, PC

(57) ABSTRACT

A switchgear including a plurality of switch units having a fixed electrode and a movable electrode; and an operating device configured to operate the movable electrode of each of the switch units, wherein the operating device is configured of one motive part and two follower parts that intermittently operate with each other, and part of each of the follower parts touches the motive part, thereby in a condition that moving force is not transmitted from the motive part to the follower part, a state of the follower part is fixed, and in a condition that the motive part shifts from an initial position to a final position, a state of one of the follower parts is allowed to transit, and a state of the other of the follower parts is changed with a delay from such state transit, thereby the switch units are driven while a time delay is produced.

11 Claims, 5 Drawing Sheets

SWITCHGEAR AND OPENING AND CLOSING METHOD THEREOF

CLAIM OF PRIORITY

The present application claims priority from Japanese Patent application serial no. 2013-120346, filed on Jun. 7, 2013, the content of which is hereby incorporated by reference into this application.

TECHNICAL FIELD

The present invention relates to a switchgear and an opening and closing method thereof, and particularly relates to a switchgear preferably used as a switchgear in which a plurality of switch units are electrically connected in series and mechanically driven, and an opening and closing method of such a switchgear.

BACKGROUND ART

In general, a high speed rail road such as Shinkansen adopts an alternate current electrification system to ensure high power. In the alternate current electrification system, since power is supplied from individual substations, a section is provided to isolate a neighbor power source. Such a configuration is specifically illustrated in FIG. 9.

As illustrated in FIG. 9, in the alternate current electrification system, an internal section 100 is disposed between two power supplies G1 and G2 in order to isolate the power supplies G1 and G2 from each other. The length of the internal section 100 is typically set to about 1 km.

When a train 101 passes through the internal section 100 from the left to the right of a sheet, a section switch VS1 is first closed to charge the internal section 100. Subsequently, while the train 101 passes through the internal section 100, the section switch VS1 is opened, and the section switch VS2 is closed so that a charge source of the internal section 100 is changed from G1 to G2. Dead time during this operation is controlled to about 0.05 to 0.3 sec, so that the train 101 can pass through the internal section 100 while maintaining its high speed condition. When the train 101 has passed through the internal section 100, the section switch VS2 is opened.

Examples of a switchgear applicable to the section switches VS1 and VS2 include a double break switch described in PTL 1 (Japanese Unexamined Patent Application Publication No. 2007-188734). In the double break switch described in PTL 1, two series switches are opened or closed substantially simultaneously.

CITATION LIST

Patent Literature

[PTL 1] Japanese Unexamined Patent Application Publication No. 2007-188734

SUMMARY OF INVENTION

Technical Problem

A vacuum switch is typically used as each of the section switches VS1 and VS2. When the vacuum switch is used in the above-described manner, the following problem occurs.

Specifically, the section switch VS2 makes a load current during passage of the train 101 through the internal section 100, and is then opened with no load after the passage of the train 101.

In the case where the section switches VS1 and VS2 are each configured of the vacuum switch, making of a load current causes a contact surface to be roughened due to pre-arc or chattering. However, as well known, such roughness is satisfied at subsequent breaking of the load current since the contact surface is melted by arc.

However, since the section switch VS2 is opened with no load, roughness of the contact surface is accumulated, leading to a possibility of degradation in electrical isolating performance. In particular, if interelectrode breakdown occurs in the section switch VS2, short circuit occurs between the power supplies G1 and G2, which leads to a serious accident that may disturb train service.

The double break switch described in PTL 1 is usable for rise of electrical isolating performance. However, since the two switches are opened or closed substantially simultaneously, if the double break switch is used as the section switch VS2, both of the contacts of the two switches maybe roughened, leading to a possibility of degradation in electrical isolating performance.

An object of the invention, which has been made in light of the above-described points, is to provide a switchgear having high electrical isolating performance in addition to capability of preventing roughening of its contact surface, and provide an opening and closing method of the switchgear.

Solution to Problem

To achieve the above-described object, a switchgear of the present invention is characterized by including: a plurality of switch units each having a fixed electrode and a movable electrode disposed to be opposed to the fixed electrode, the movable electrode being closed or opened with respect to the fixed electrode; an operating device configured to operate the movable electrode being closed or opened with respect to the fixed electrode of each of the switch units; and a conductor configured to electrically connect the switch units to each other, wherein the operating device is configured of one motive part and two follower parts that intermittently operate with each other, and part of each of the follower parts touches the motive part, thereby in a condition that moving force is not transmitted from the motive part to the follower part, a state of the follower part is fixed, and in a condition that the motive part shifts from an initial position to a final position, a state of one of the follower parts is allowed to transit, and a state of the other of the follower parts is changed with a delay from such state transit, thereby the switch units are driven while a time delay is produced.

Further, to achieve the above-described object, a switchgear of the present invention is characterized by including: a plurality of switch units each having a fixed electrode and a movable electrode disposed to be opposed to the fixed electrode, the movable electrode being closed or opened with respect to the fixed electrode; an operating device configured to operate the movable electrode being closed or opened with respect to the fixed electrode of each of the switch units; and a conductor configured to electrically connect the switch units to each other, wherein the switchgear is provided with a Geneva drive in which the operating device is configured of one motive part and two follower parts, the motive part having a floating pin that rotates with the motive part, and each of the two follower parts has a guide slit with which the floating pin of the motive part is to engage, and the floating pin engages with the guide slit of one of the follower parts along with rotation of the motive part, and when the floating pin is disengaged from the guide slit, the floating pin engages with a guide slit of the other of the follower parts, thereby the switch units are driven while a time delay is produced.

Furthermore, an opening and closing method of a switchgear of the present invention is characterized in that, with a plurality of switch units that each have a fixed electrode and a movable electrode disposed to be opposed to the fixed electrode, the movable electrode being closed or opened with respect to the fixed electrode, and are electrically connected to each other by a conductor, when the movable electrode being closed or opened with respect to the fixed electrode of each of the switch units is operated by an operating device configured of one motive part and two follower parts, the motive part and the follower parts intermittently operate with each other, and part of each of the follower parts touches the motive part, thereby in a condition that moving force is not transmitted from the motive part to the follower part, a state of the follower part is fixed, and in a condition that the motive part shifts from an initial position to a final position, a state of one of the follower parts is allowed to transit, and a state of the other of the follower parts is changed with a delay from such state transit, thereby the switch units are driven while a time delay is produced.

Advantageous Effects of Invention

According to the present invention, it is possible to provide a switchgear having high electrical isolating performance in addition to capability of preventing roughening of its contact surface

DESCRIPTION OF EMBODIMENTS

Hereinafter, a switchgear and an opening and closing method of the switchgear of the present invention are described based on Examples with the accompanying drawings. In the following Examples, identical components are designated by identical numerals or signs.

EXAMPLE 1

Figure 1:
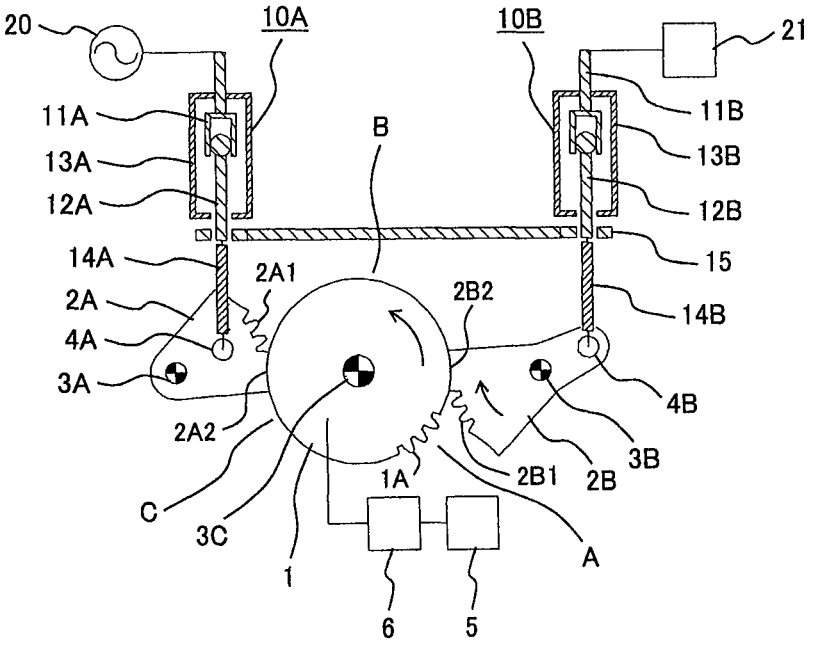
FIG. 1 is a schematic configuration diagram of Example 1 of a switchgear of the present invention, showing a state where two switch units are closed.
Figure 2:
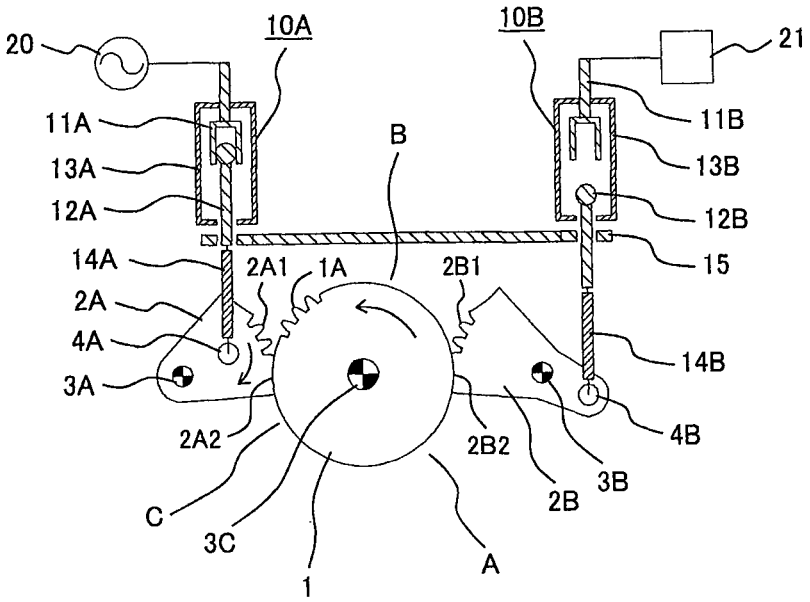
FIG. 2 is a schematic configuration diagram of Example 1 of the switchgear of the present invention, showing a state where one switch unit is opened.
Figure 3:
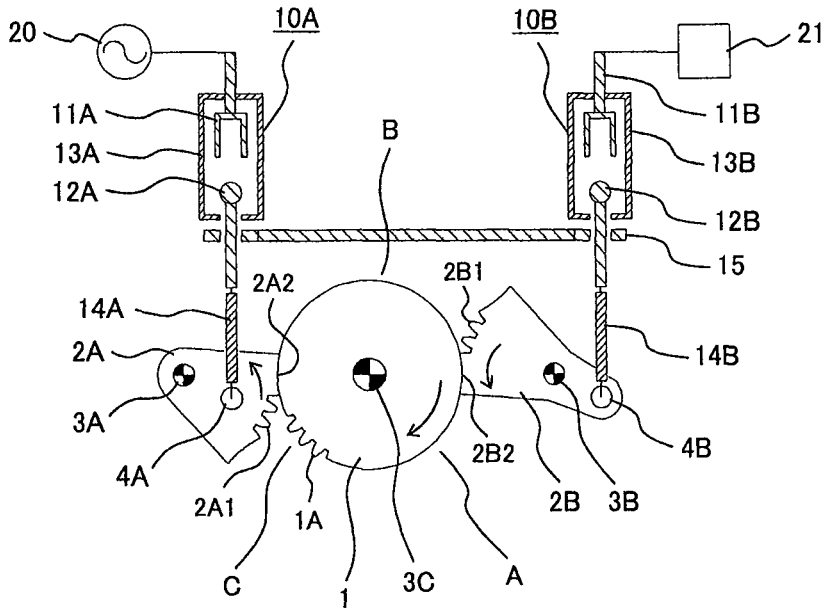
FIG. 3 is a schematic configuration diagram of Example 1 of the switchgear of the present invention, showing a state where the two switch units are opened.

FIGS. 1 to 3 illustrate Example 1 of a switchgear of the present invention. As illustrated in such drawings, the switchgear of Example 1 is disposed such that drive directions are parallel to each other, and is roughly configured of switch units 10A and 10B each configured to make or break a current, a conductor 15 configured to electrically connect the switch units 10A and 10B to each other, operating rods 14A and 14B configured to operate electrodes of the switch units 10A and 10B, respectively, an operating device that is configured of one motive gear 1 and two follower gears 2A and 2B and is configured to operate the operating rods 14A and 14B, a motor 5 as a power source for driving the motive gear 1, and a power transmission mechanism 6 configured to transmit power from the motor 5 to the motive gear 1.

To describe more in detail, fixed electrodes 11A and 11B and movable electrodes 12A and 12B are accommodated within arc extinguishing chambers 13A and 13B of the switch units 10A and 10B, respectively. The fixed electrodes 11A and 11B and the movable electrodes 12A and 12B are opened or closed with respect to each other, thereby current is made or blocked.

The fixed electrode 11A of the switch unit 10A is electrically connected to a power supply 20, while the fixed electrode 11B of the switch unit 10B is electrically connected to a load 21. The movable electrode 12A of the switch unit 10A is electrically connected to the movable electrode 12B of the switch unit 10B with the conductor 15 such as a flexible conductor, so that the switch units 10A and 10B are electrically connected in series to each other.

The movable electrodes 12A and 12B are connected to first ends of the operating rods 14A and 14B, respectively, and second ends of the operating rods 14A and 14B are engaged with the follower gears 2A and 2B by means of floating pins 4A and 4B, respectively. Furthermore, the follower gears 2A and 2B are fixed in a pivotable manner about fixed pins 3A and 3B, respectively, and the motive gear 1 is fixed in a pivotable manner about a fixed pin 3C.

As illustrated in FIG. 1, in a state where cogs 1A, which are provided on part of the whole circumference of the motive gear 1, are in an initial position A, the switch units 10A and 10B are each closed (the fixed electrodes 11A and 11B are in contact with the movable electrodes 12A and 12B, respectively.). In this state, concave parts (curved surface parts) 2A2 and 2B2 lateral to the cogs 2A1 and 2B1 of the follower gears 2A and 2B each touch the outer periphery with no cog of the circular motive gear 1; hence, the follower gears 2A and 2B do not turn about the fixed pins 3A and 3B, respectively, i.e., maintain their current states.

In this state, when drive force is exerted counterclockwise on the motive gear 1 from the motor 5 via the power transmission mechanism 6, the motive gear 1 turns counterclockwise about the fixed pin 3C. When the cogs 1A of the motive gear 1 engage with cogs 2B1 of the follower gear 2B, the follower gear 2B turns clockwise about the fixed pin 3B. As a result, the state transits to a state as illustrated in FIG. 2. At this time, the switch unit 10B is opened (the fixed electrode 11B is opened with respect to the movable electrode 12B), and a concave part 2B2 lateral to the cogs 2B1 of the follower gear 2B touches the outer periphery with no cog of the motive gear 1. Hence, the switch unit 10B is maintained to be opened.

If a current is applied from the power supply 20 to the load 21 via the switch unit 10A, the conductor 15, and the switch unit 10B, the current is broken at the switch unit 10B.

The motive gear 1 is further turned counterclockwise, so that the cogs 1A of the motive gear 1 engage with the cogs 2A1 of the follower gear 2A. As a result, the follower gear 2A is turned clockwise about the fixed pin 3A, and the state transits to a state as illustrated in FIG. 3. At this time, the switch unit 10A is opened with no load. In the state illustrated in FIG. 3, the concave part 2A2 lateral to the cogs 2A1 of the follower gear 2A touches the outer periphery with no cog of the motive gear 1; hence, the switch unit 10A is maintained to be opened.

Conversely, when the motive gear 1 is turned clockwise in the state illustrated in FIG. 3, the state is returned to the state illustrated in FIG. 1 via the state illustrated in FIG. 2.

Figure 4:
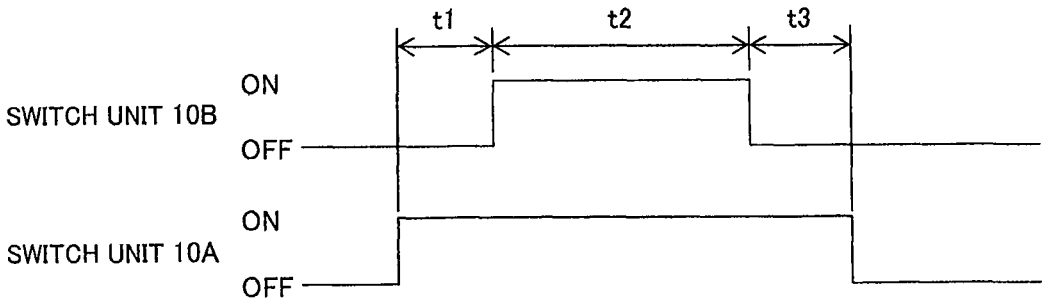
FIG. 4 is a diagram for explaining switching operation timing of each of the two switch units in Example 1 of the switchgear of the present invention.

In the operation of each of the switch units 10A and 10B, timing is specifically set as illustrated in FIG. 4. Specifically, in closing operation, the switch unit 10A is first closed, and then the switch unit 10B is closed after time t1. Since the two switch units 10A and 10B are disposed in series, the power supply 20 is actually connected to the load 21 at the latter closing of the switch unit 10B. On the other hand, in opening operation, the switch unit 10A is opened after time t3 from opening of the switch unit 10B.

To summarize the Example 1 described hereinbefore, the motive gear 1 and the follower gears 2A and 2B intermittently operate with each other, and in a condition that part (the concave part 2B2) of the follower gear 2B touches the motive gear 1 and thus moving force is not transmitted from the motive gear 1 to the follower gear 2B, a state of the follower gear 2B is fixed. In a condition that the motive gear 1 shifts from the initial position A to the final position C, a state of one follower gear 2B is allowed to transit, and a state of the other follower gear 2A is changed with a delay from such state transit, thereby the switch units 10A and 10B are driven while a time delay is produced.

Figure 9:
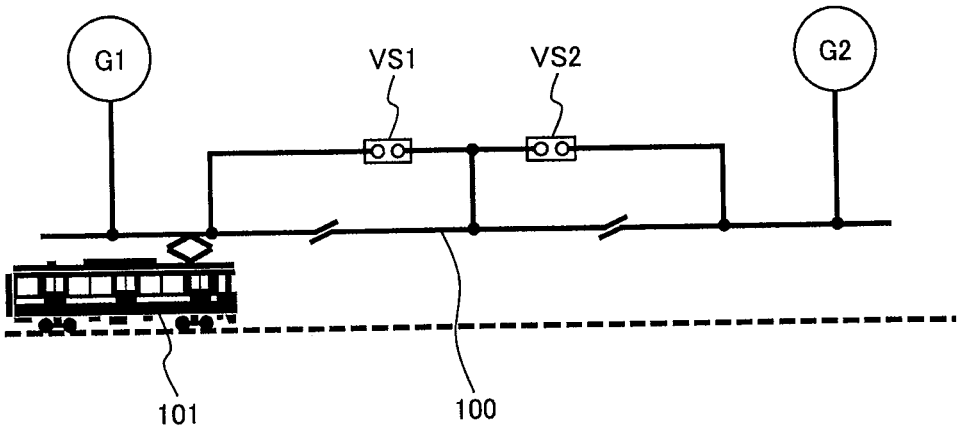
FIG. 9 is a diagram for explaining a function of a section switch in a typical alternate current electrification system.

Effects of the above-described Example 1 are now described. Although a vacuum switch is typically used as each of the section switches VS1 and VS2 illustrated in FIG. 9, if the vacuum switch is used in the above-described manner, the section switch VS2 is repeatedly subjected to load making and no-load breaking. Hence, roughness of the contact surface is gradually increased, leading to a possibility of reduction in withstanding voltage.

In contrast, if the double break switch described in the Example 1 is used as the section switch, the switch unit 10A is opened after breaking of a current after opening of the switch unit 10B. Hence, the contact surface is melted by arc and roughness is satisfied, so that roughening of the contact surface is prevented. In addition, the switch unit 10A can maintain its initial electrical isolating performance since it does not make or break a current.

Conversely, the switch unit 10B can be specialized in current interrupting performance; hence, a double break switch having high withstanding voltage and low-surge performance can be achieved through use of an Ag—W—C material as a low-surge material.

As a rough criterion, t1 is adjusted to 10 ms or more in order to avoid pre-arcing in the disconnecting switch unit 10A during closing operation. In addition, t3 is adjusted to 20 ms or more to prevent breaking current in the disconnecting switch unit 10A during opening operation. Rotation speed or gear radius of the motive gear 1 should be appropriately designed to allow such time to be secured.

According to the Example 1, it is possible to provide a switchgear having high electrical isolating performance in addition to capability of preventing roughening of its contact surface.

EXAMPLE 2

Figure 5:
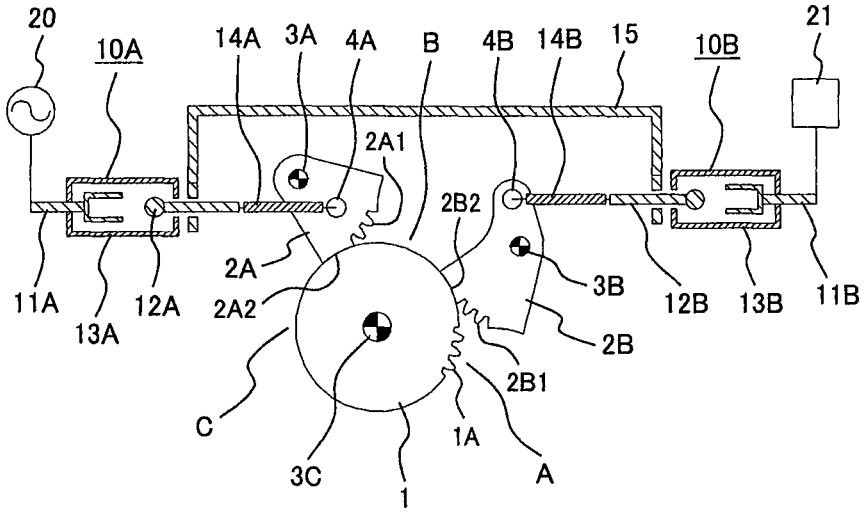
FIG. 5 is a schematic configuration diagram of Example 2 of the switchgear of the present invention, showing a state where two switch units are opened.

FIG. 5 illustrates Example 2 of the switchgear of the invention. The Example 2 illustrated in FIG. 5 is characterized in that the switch units 10A and 10B are disposed such that their drive directions are in the same line. Other configurations are the same as those in the Example 1.

According to the Example 2, effects similar to those in the Example 1 can be attained. In addition, an elongation distance between the fixed electrode 11A of the switch unit 10A, to which the power supply 20 is to be connected, and the fixed electrode 11B of the switch unit 10B, to which the load 21 is to be connected, can be designed long, so that the switchgear is advantageously used as a high rated voltage switchgear.

EXAMPLE 3

Figure 6:
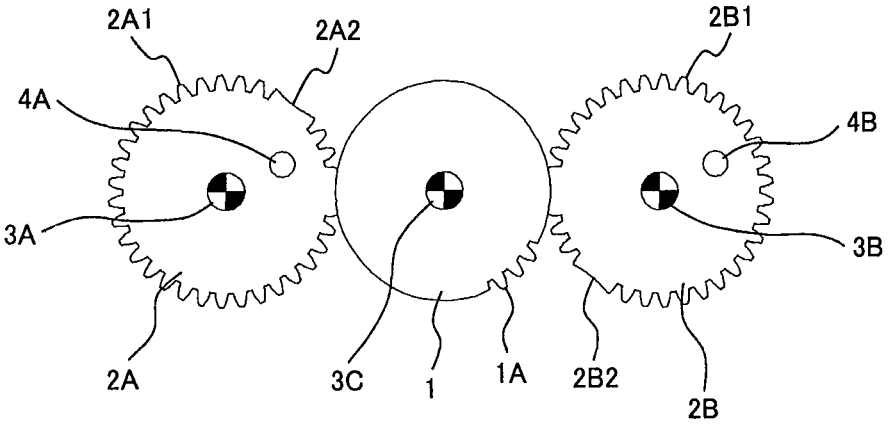
FIG. 6 is a configuration diagram illustrating a motive gear and follower gears of a switch in Example 3 of the switchgear of the present invention.

FIG. 6 illustrates Example 3 of the switchgear of the invention. In the Example 3 illustrated in FIG. 6, while the motive gear 1 has the cogs 1A on part of its whole circumference, the follower gears 2A and 2B have cogs 2A1 and 2B1, respectively, on their whole circumferences. Other configurations are the same as those in the Example 1.

According to the Example 3, effects similar to those in the Example 1 can be attained. In addition, in the case where a standard spur gear is available, the follower gears 2A and 2B can be fabricated only through additional machining of cog lack parts (concave parts 2A2 and 2B2).

EXAMPLE 4

Figure 7:
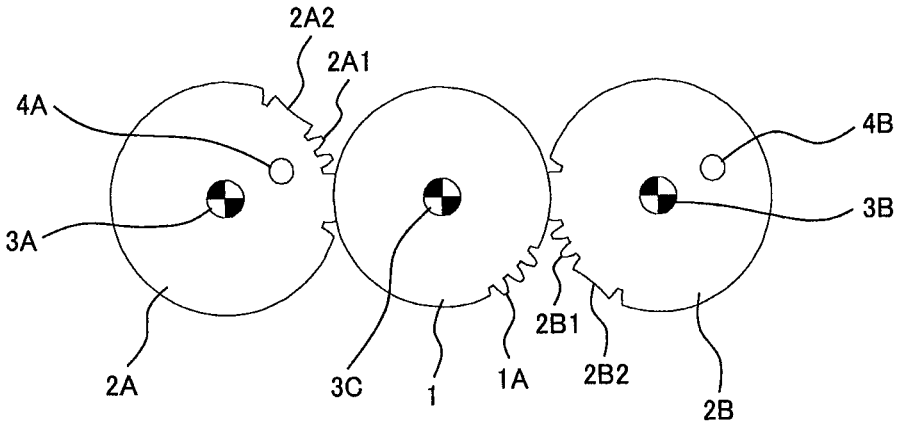
FIG. 7 is a configuration diagram illustrating a motive gear and follower gears of a switch in Example 4 of the switchgear of the present invention.

FIG. 7 illustrates Example 4 of the switchgear of the invention. In the Example 4 illustrated in FIG. 7, while the motive gear 1 has the cogs 1A on part of its whole circumference, the follower gears 2A and 2B are fabricated through additional machining of cogs 2A1 and 2B1 and concave parts 2A2 and 2B2 on a disc as a base. Other configurations are the same as those in the Example 1.

According to the Example 4, effects similar to those in the Example 1 can be attained. In addition, the follower gears 2A and 2B can be fabricated only through additional machining of the cogs 2A1 and 2B1 and the concave parts 2A2 and 2B2 on a disc as a base, and therefore processing cost is advantageously reduced.

EXAMPLE 5

Figure 8:
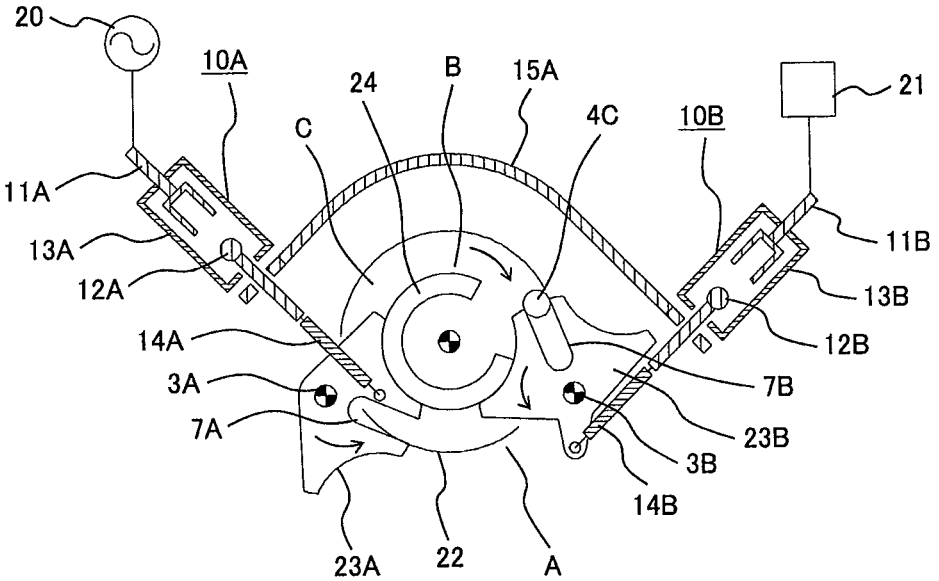
FIG. 8 is a schematic configuration diagram of Example 5 of the switchgear of the present invention, showing a state where two switch units are opened.

FIG. 8 illustrates Example 5 of the switchgear of the invention. The Example 5 illustrated in FIG. 8 has a structure in which the mechanical intermittent motion of each of the switch units 10A and 10B is achieved using a Geneva drive.

Specifically, the switchgear of the Example 5 includes: switch units 10A and 10B having fixed electrodes 11A and 11B and movable electrodes 12A and 12B that are disposed to be opposed to the fixed electrodes 11A and 11B and are closed or opened with respect to the fixed electrodes 11A and 11B, respectively; an operating device that is configured of one motive gear 22 and two follower gears 23A and 23B, and is configured to operate the movable electrodes 12A and 12B being closed or opened with respect to the fixed electrodes 11A and 11B of the switch units 10A and 10B, respectively; and a conductor 15A configured to electrically connect the switch units 10A and 10B to each other, wherein the switchgear is provided with a Geneva drive in which the motive gear 22 has a movable pin 4C configured to rotate with the motive gear 22, and the two follower gears 23A and 23B have guide slits 7A and 7B with which the movable pin 4C of the motive gear 22 is to engage, and the movable pin 4C engages with the guide slit 7B of one follower gear 23B along with rotation of the motive gear 22, and when the movable pin 4C is disengaged from the guide slit 7B, the movable pin 4C engages with a guide slit 7A of the other follower gear 23A, and thereby the switch units 10A and 10B are driven while a time delay is produced. Each of the follower gears 23A and 23B turns along an arcuate guide component 24 fixed to the motive gear 22.

According to the Example 5, effects similar to those in the Example 1 can be attained. In addition, the switch units 10A and 10B are advantageously arranged in an orthogonal manner.

The invention further includes various modifications of the above-described Examples without limitation. For example, while the above-described Examples have been described in detail for ease in understanding of the invention, the invention is not necessarily limited to such Examples having all the described configurations. In addition, part of a configuration of an Example may be replaced with a configuration of another Example. Furthermore, a configuration of an Example may be additionally provided with a configuration of another Example. In addition, part of a configuration of each Example may be additionally provided with a configuration of another Example, omitted, or replaced with a configuration of another Example.

REFERENCE SIGNS LIST

1, 22 . . . motive gear, 1A . . . cog of motive gear, 2A, 2B, 23A, 23B . . . follower gear, 2A1, 2B1 . . . cog of follower gear, 2A2, 2B2 . . . concave part of follower gear, 3A, 3B, 3C . . . fixed pin, 4A, 4B, 4C . . . movable pin, 5 . . . motor, 6 . . . power transmission mechanism, 7A, 7B . . . guide slit, 10A, 10B . . . switch unit, 11A, 11B . . . fixed electrode, 12A, 12B . . . movable electrode, 13A, 13B . . . arc extinguishing chamber, 14A, 14B . . . operating rod, 15, 15A . . . conductor, 20, G1, G2 . . . power supply, 21 . . . load, 24 . . . guide component, 100 . . . internal section, 101 . . . train, VS1, VS2 . . . section switch, A . . . initial position, B . . . intermediate position, C . . . final position.

The invention claimed is:

1. A switchgear, comprising:

a plurality of switch units each including a fixed electrode and a movable electrode disposed opposite to the fixed electrode, the movable electrode being closed or opened with respect to the fixed electrode;

an operating device configured to operate the movable electrode being closed or opened with respect to the fixed electrode of each of the switch units; and a conductor configured to electrically connect the switch units to each other, wherein the operating device is configured of one motive gear and two follower gears that intermittently operate with each other, wherein the motive gear has cogs around a portion of the circumference of the motive gear, wherein each of the two follower gears has cogs around a portion of the circumference of the follower gear, wherein the motive gear is driven by power of a motor transmitted via a power transmission mechanism, and a drive force of the motive gear is transmitted to a follower gear through engagement of the cogs of the motive gear with the cogs of a follower gear, and the drive force transmitted to each of the follower gears is transmitted to the respective movable electrodes via respective operating rods, which are connected to each of the respective follower gears, wherein in a condition that the cogs of the motive gear do not engage with the cogs of a follower gear, a state of the follower gear is fixed, wherein in a condition that the motive gear shifts from an initial position to a final position, the cogs of one of the two follower gears engages with the cogs of the motive gear, and the cogs of the other of the two follower gears engages with the cogs of the motive gear asynchronously with respect to the engagement of the cogs of the one following gear, thereby the switch units are driven while a time delay is produced.

2. The switchgear according to claim 1, wherein in the engagement of the cogs of the motive gear with the cogs of each of the follower gears, cogs of one of the follower gears engage with the cogs of the motive gear, and then cogs of the other of the follower gears engage with the cogs of the motive gear after a time delay.

3. The switchgear according to claim 1, wherein each of the operating rods has a first end engaged with one of the follower gears via a movable pin fixed on each of the follower gears, and a second end connected to the movable electrode, and each of the follower gears is fixed in a pivotable manner about a fixed pin, and the motive gear is fixed in a pivotable manner about another fixed pin.

4. The switchgear according to claim 1, wherein the switch units are disposed such that drive directions of the switch units are parallel to each other.

5. The switchgear according to claim 1, wherein the switch units are disposed such that drive directions of the switch units are in the same line.

6. The switchgear according to claim 1, wherein each of the follower gears has cogs on the whole circumference of the follower gear.

7. A switchgear, comprising:

a plurality of switch units each having a fixed electrode and a movable electrode disposed to be opposed to the fixed electrode, the movable electrode being closed or opened with respect to the fixed electrode; an operating device configured to operate the movable electrode being closed or opened with respect to the fixed electrode of each of the switch units; and a conductor configured to electrically connect the switch units to each other, wherein the switchgear is provided with a Geneva drive in which the operating device is configured of one motive part and two follower parts, the motive part having a movable pin that rotates with the motive part, and each of the two follower parts has a guide slit with which the movable pin of the motive part is to engage, and the movable pin engages with the guide slit of one of the follower parts along with rotation of the motive part, and when the movable pin is disengaged from the guide slit, the movable pin engages with a guide slit of the other of the follower parts, thereby the switch units are driven while a time delay is produced.

8. The switchgear according to claim 7, wherein the motive part is driven by power of a motor transmitted via a power transmission mechanism, and drive force of the motive part is transmitted to each of the follower parts, and the movable electrode is operated by the drive force transmitted to each of the follower parts.

9. The switchgear according to claim 7, wherein the switch units are disposed such that drive directions of the switch units are orthogonal to each other.

10. An opening and closing method of a switchgear, comprising a plurality of switch units that each include a fixed electrode and a movable electrode disposed opposite to the fixed electrode, the movable electrode being closed or opened with respect to the fixed electrode, a conductor configured to electrically connect the switch units to each other, an operating device configured of one motive gear and two follower gears that intermittently operate with each other, wherein the motive gear has cogs around a portion of the circumference of the motive gear and each of the two follower gears has cogs around a portion of the circumference of the follower gear, the method comprising:

driving the motive gear by power of a motor transmitted via a power transmission mechanism;

transmitting a drive force of the motive gear to a follower gear through engagement of the cogs of the motive gear with the cogs of a follower gear, transmitting the drive force transmitted to each of the follower gears to the respective movable electrodes via respective operating rods, which are connected to each of the respective follower gears, maintaining in a fixed position a state of a follower part, rotating the motive gear from an initial position to a final position, and during the rotation the cogs of one of the two follower gears engages with the cogs of the motive gear, and the cogs of the other of the two follower gears engages with the cogs of the motive gear asynchronously with respect to the engagement of the cogs of the one following gear.

11. The opening and closing method of a switchgear according to claim 10, wherein in the engagement of the cogs of the motive gear with the cogs of each of the follower gears, cogs of one of the follower gears engage with the cogs of the motive gear, and then cogs of the other of the follower gears engage with the cogs of the motive gear with a time delay.

* * * * *